US005593238A

United States Patent [19]

Fox et al.

[11] Patent Number: 5,593,238

[45] Date of Patent: Jan. 14, 1997

[54] METHOD AND APPARATUS FOR CONTROLLING TRANSPORT OF THERMAL TRANSFER RIBBON

[75] Inventors: Duane M. Fox, Snohomish; Joel Schoen, Woodinville, both of Wash.

[73] Assignee: Intermec Corporation, Everett, Wash.

[21] Appl. No.: 294,082

[22] Filed: Aug. 22, 1994

[51] Int. Cl.[6] ..... B41J 33/52

[52] U.S. Cl. ..... 400/234; 400/235; 400/225

[58] Field of Search ..... 400/225, 231, 400/232, 234, 235, 235.1, 236, 236.1, 236.2; 347/215, 216, 217, 218, 219

[56] References Cited

U.S. PATENT DOCUMENTS

| | | | |
|---|---|---|---|
| 4,558,963 | 12/1985 | Applegate et al. | 400/235.1 |
| 4,657,418 | 4/1987 | Lahr | 400/235.1 |
| 4,812,063 | 3/1989 | Kunimitsu et al. | 400/234 |
| 4,860,025 | 8/1989 | Berson et al. | 400/120 |
| 4,878,773 | 11/1989 | Mazumder | 400/232 |
| 4,919,555 | 4/1990 | Kikuchi | 400/234 |
| 4,934,847 | 6/1990 | Shiozaki et al. | 400/234 |
| 4,949,098 | 8/1990 | Gluck et al. | 400/120 |
| 4,953,994 | 9/1990 | Shiozaki et al. | 400/708 |
| 4,973,985 | 11/1990 | Genno et al. | 400/234 |
| 4,974,977 | 12/1990 | Morgan et al. | 400/234 |
| 4,982,202 | 1/1991 | Buan et al. | 400/194 |
| 5,032,032 | 7/1991 | Chu et al. | 400/234 |
| 5,040,461 | 8/1991 | Van-Ocker | 400/232 |
| 5,122,882 | 6/1992 | Ishida et al. | 400/232 |
| 5,372,439 | 12/1994 | Poole et al. | 400/232 |

FOREIGN PATENT DOCUMENTS

| | | | |
|---|---|---|---|
| 0294792 | 12/1988 | European Pat. Off. . | |
| 0500008 | 8/1992 | European Pat. Off. . | |
| 58-201686 | 11/1983 | Japan . | |
| 60-018362 | 1/1985 | Japan | 347/215 |
| 61-116568 | 6/1986 | Japan . | |
| 61-135773 | 6/1986 | Japan | 347/215 |
| 62-181168 | 8/1987 | Japan . | |
| 3-178457 | 8/1991 | Japan | 347/215 |

*Primary Examiner*—David A. Wiecking
*Attorney, Agent, or Firm*—Graham & James LLP

[57] ABSTRACT

An apparatus for use in a thermal printer for printing bar code symbols onto a paper substrate material is provided which utilizes a ribbon having a multi-transfer ink layer. The thermal printer enables the ink ribbon to be transported at a rate that is selectively lower than the transporting rate of the paper substrate. The thermal printer comprises a platen and a thermal head disposed adjacent to the platen having a region defined therebetween through which the paper substrate material is transported at a first rate. Images or symbols are imprinted onto the paper substrate material by operation of the thermal head in cooperation with ink from the multi-transfer ink ribbon advanced to the region. A supply hub carries a supply of the ribbon, and a first motor is mechanically linked to the supply hub. The first motor rotates the hub in a direction opposite to a direction of advancement of the ribbon. A roller is mechanically linked to the first motor and has a surface engaging the ribbon provided with a friction coefficient sufficient to prevent slippage of the ribbon across the surface. A second motor applies a tension on the ribbon, and a clutch interposed between the first motor and the supply hub permits controlled slippage of the supply hub to permit advancement of the ribbon. A take-up hub mechanically linked to the second motor receives the ribbon after its passage through the region between the platen and the thermal head.

9 Claims, 5 Drawing Sheets

METHOD AND APPARATUS FOR CONTROLLING TRANSPORT OF THERMAL TRANSFER RIBBON

BACKGROUND OF THE INVENTION

1. Field of the Invention

The present invention relates to thermal transfer printing, and more particularly, to a method and apparatus for printing bar code symbology, text or graphics onto a paper substrate in which an ink ribbon is advanced at a rate substantially lower than the advance rate of the paper substrate.

2. Description of Related Art

In the field of bar code symbology, vertical bars of varying thicknesses and spacing are used to convey information, such as an identification of the object to which the bar code is affixed. The bar codes are typically printed onto paper substrate labels having an adhesive backing layer that enables the labels to be affixed to objects to be identified. To read the bar code, the bars and spaces are scanned by a light source, such as a laser. Since the bars and spaces have differing light reflective characteristics, the information contained in the bar code can be read by interpreting the laser light that reflects from the bar code. In order to accurately read the bar code, it is thus essential that the bar code be printed in a high quality manner, without any streaking or blurring of the bar code. At the same time, it is essential that the adhesive backing layer of the labels not be damaged by heat generated during the printing process.

In view of these demanding printing requirements, bar code is often printed using thermal transfer printing techniques. In thermal transfer printing, an ink ribbon and a label sheet are pressed between a platen and a thermal print head. The thermal print head has linearly disposed printing elements that extend across a width of the label sheet. The printing elements are individually activated in accordance with instructions from a controller. As each printing element activates, ink from the ribbon at the location of the particular printing element is transferred onto the paper of the label sheet to produce the printed area. Both the ink ribbon and the label sheet are continuously drawn through the region between the platen and thermal print head, and in so doing, the bar code is printed onto the label as it passes through the region. Other images, such as text characters, are printed in the same manner.

The thermal transfer printer includes a mechanism for transporting both the label sheet and the ink ribbon from respective supply hubs to the print region. The transporting mechanism controls the feed rate of the label sheet and ink ribbon, and maintains a positive tension on the ink ribbon so as to prevent its wrinkling which could cause a defect in the printed bar code. If the ink ribbon were to stop temporarily under the thermal print head, the ribbon itself could be burned entirely through, causing the ribbon to tear. Traditionally, the ink ribbon was formulated so that all the ink is transferred from the ribbon during each successive pass across the label sheet. Thus, the ink ribbon must be transported at precisely the same rate as the label sheet to obtain substantially defect-free printing.

A significant drawback of this type of transporting mechanism is that it is wasteful of the ink ribbon. Since the printed area often represents only a limited portion of the overall label field, a quantity of the ribbon passes through the print region without transferring any ink to the label sheet. The unused ink can be salvaged by running the ink ribbon through the print region a second time with a new label sheet, though this method has an associated risk of defective printing if a previously transferred location of the ink ribbon reaches the print region at an instant in which a print operation is to occur.

A new formulation of ink ribbon allows only a portion of the ink to be transferred on each successive pass, permitting multiple transfers of ink from the same location on the ribbon. This capability enables the ink ribbon to be run through the print region two or more times before exhausting the ribbon, with less risk of defective printing. Nevertheless, each time the ribbon is passed through the print region, the transporting mechanism places stresses on the ribbon that stretch or weaken the ribbon, increasing the associated risk of tearing or wrinkling the ribbon. In addition, each pass of the ribbon results in lower print quality than that of the previous pass.

Accordingly, it would be desirable to provide a transporting mechanism for a thermal printer that is capable of taking advantage of the new formulation of ink ribbon by making most efficient use of the entire ink ribbon during a single pass through the print region. Ideally, the transporting mechanism would be capable of transporting the ribbon at a selectively slower rate than the label sheet, and would further be able to transport the ribbon at the slowest possible rate during the spaces between print operations.

SUMMARY OF THE INVENTION

In accordance with the teachings of the present invention, a thermal printer for printing bar code symbols onto a paper substrate material is provided which utilizes a ribbon having a multi-transfer ink layer. The thermal printer enables the ink ribbon to be transported at a rate that is selectively lower than the transport rate of the paper substrate.

The thermal printer comprises a platen and a thermal head disposed adjacent to the platen having a region defined therebetween through which the paper substrate material is transported at a first rate. Symbols are imprinted onto the paper substrate material by operation of the thermal head in cooperation with ink from the multi-transfer ink ribbon advanced to the region. A supply hub carries a supply of the ribbon, and a first motor is mechanically linked to the supply hub. The first motor rotates the hub in a direction opposite to a direction of advancement of the ribbon. A roller is mechanically linked to the first motor and has a surface engaging the ribbon provided with a friction coefficient sufficient to prevent slippage of the ribbon across the surface. A second motor applies a tension on the ribbon, and a clutch interposed between the first motor and the supply hub permits controlled slippage of the supply hub to permit advancement of the ribbon. A take-up hub mechanically linked to the second motor receives the ribbon after its passage through the print region between the platen and the thermal head.

In an embodiment of the present invention, the first motor is a stepper motor. A ratio between the first rate of the paper substrate and the second rate of the ink ribbon is at least 2:1, and could be up to 8:1 or more. Additionally, the second rate can be selectively reduced between printing operations of the bar code symbols to advance rates of 20:1 or more.

The present invention further provides a method for printing information onto a paper substrate material for use with a multi-pass ink ribbon. The method comprises supplying the paper substrate to a print region disposed between a platen and a thermal head disposed adjacent the platen at a first rate, transporting the ribbon to the print region at a second rate that is substantially less than the first rate, and printing the information onto the paper substrate by operation of the thermal head. The method further comprises selectively reducing the second rate between printing operations of the information.

A more complete understanding of the method and apparatus for controlling transport of thermal transfer ribbon will be afforded to those skilled in the art, as well as a realization of additional advantages and objects thereof, by a consideration of the following detailed description of the preferred embodiment. Reference will be made to the appended sheets of drawings which will first be described briefly.

DETAILED DESCRIPTION OF THE PREFERRED EMBODIMENT

The present invention provides a transporting mechanism for a thermal printer that makes maximum use of the multi-transfer ink ribbon during a single pass through the print region. The transporting mechanism is capable of transporting the ribbon at a selectively slower rate than the label sheet, and is able to transport the ribbon at the slowest possible rate during the spaces between bar code print operations.

Figure 1:
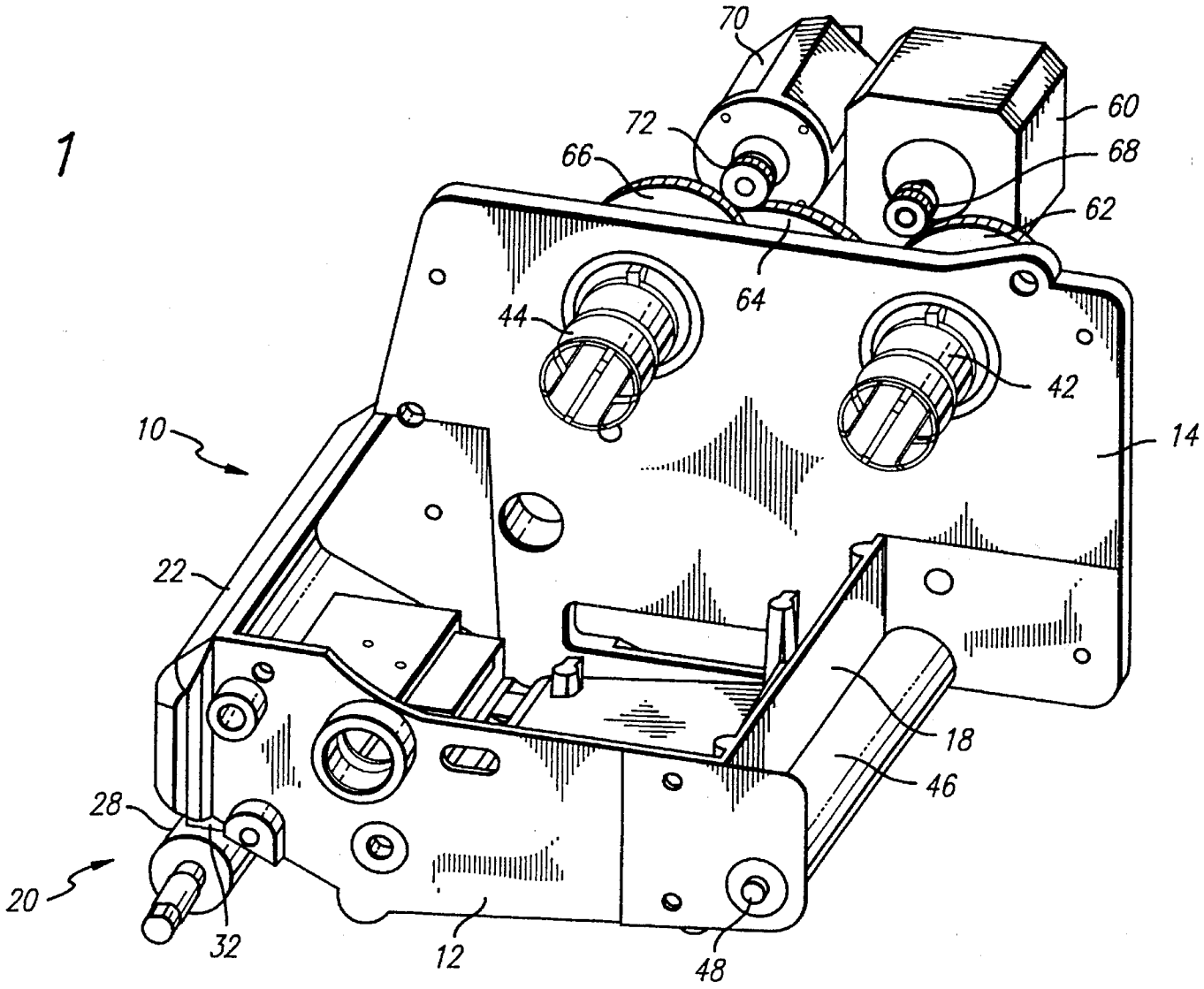
FIG. 1 is a front perspective view of a transporting mechanism for a thermal transfer printer of the present invention.
Figure 2:
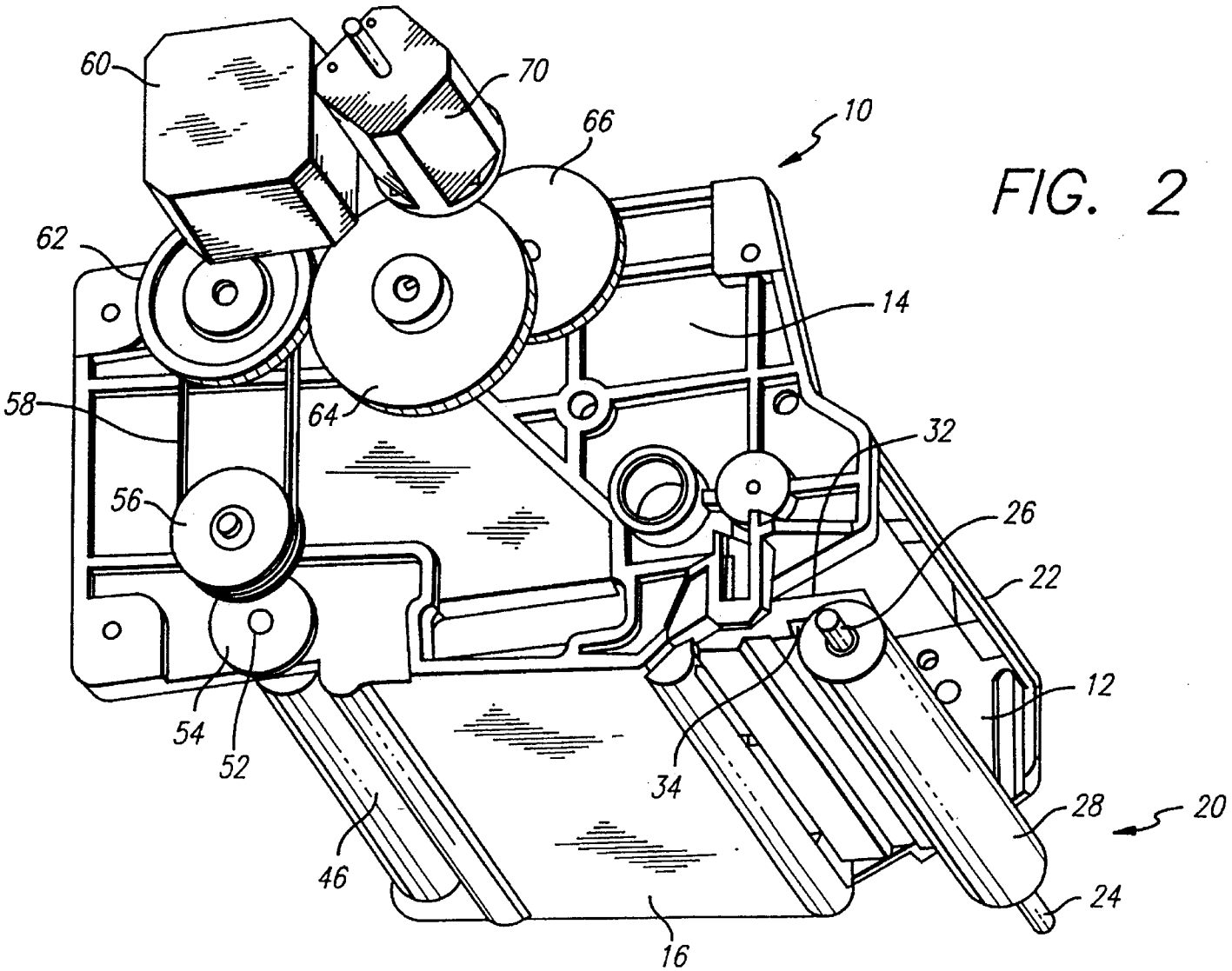
FIG. 2 is a rear perspective view of the transporting mechanism for the thermal transfer printer.
Figure 3:
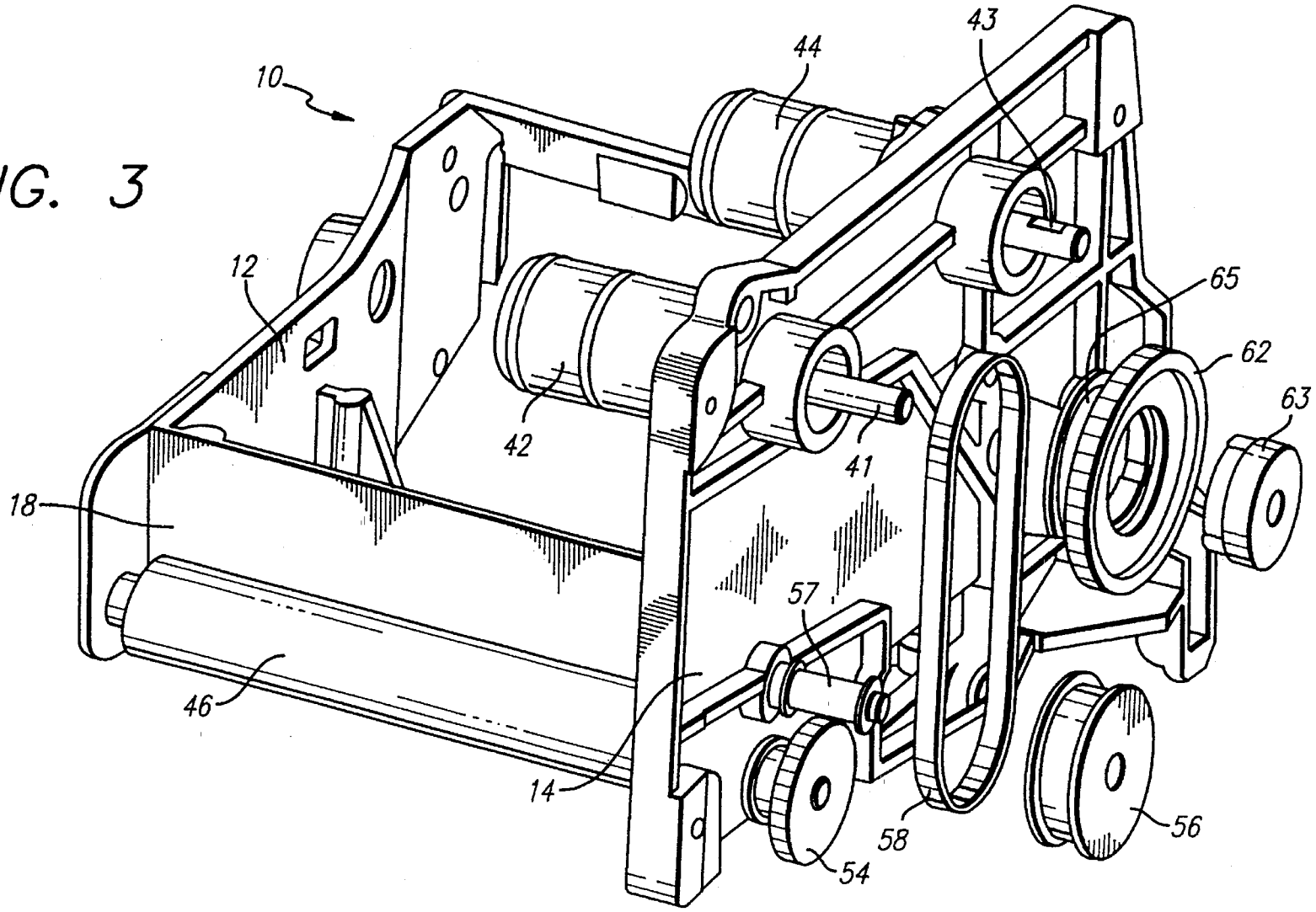
FIG. 3 is a side perspective view of the transporting mechanism for the thermal transfer printer.
Figure 4:
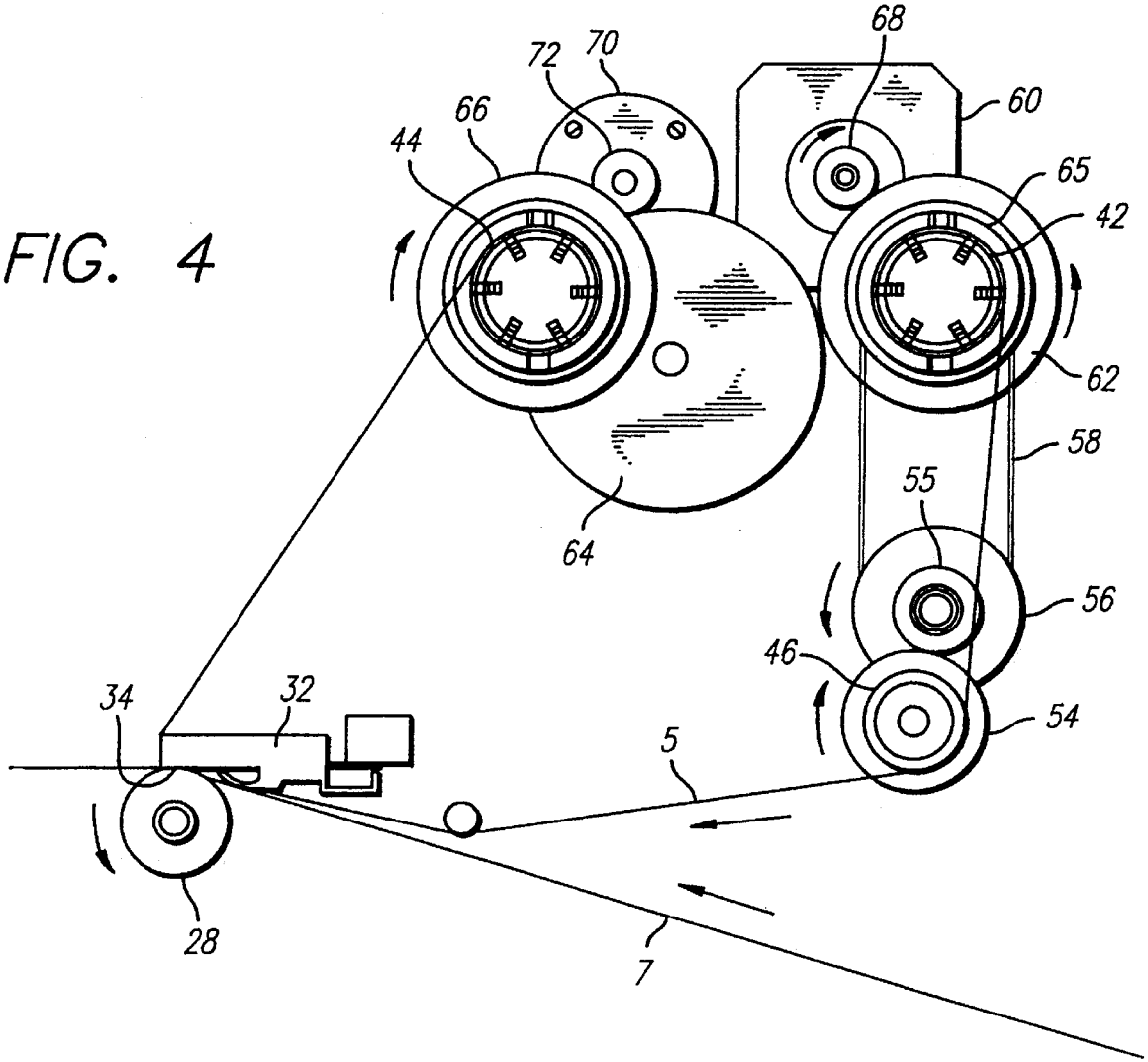
FIG. 4 is diagram illustrating the transport path of a multi-pass ink ribbon and label sheet within the transporting mechanism for the thermal transfer printer.

Referring first to FIGS. 1–3, a transporting mechanism 10 for a thermal transfer printer of the present invention is illustrated. It is anticipated that the transporting mechanism 10 be operable within the environment of a thermal transfer printer (not shown) that provides control signals to the transporting mechanism. The printer would further supply a paper substrate material in the form of sheet labels onto which images, symbols or text would be printed.

The transporting mechanism 10 includes a forward frame member 12 disposed parallel with a rearward frame member 14. The forward and rearward frame members 12, 14 are separated by a fixed, predetermined distance that corresponds with a width dimension of the sheet labels. As illustrated, the rearward frame member 14 has a height dimension substantially larger than the forward frame member 12, which permits the installation and removal of ribbon carrying hubs, as will be described in greater detail below. The rearward frame member 14 provides structural integrity for the transporting mechanism, and should be comprised of a high strength, light weight material which resists warping, such as aluminum.

The forward and rearward frame members 12, 14 are joined by a bottom plate 16, a left side plate 22, and a right side plate 18. The bottom and side plates 12, 22, 18 provide structural integrity to the transporting mechanism 10, and further provide surfaces which protect against damage to the ink ribbon. As will be further described below, these surfaces further guide in the transportation of the ink ribbon and sheet label.

A platen 20 is disposed at a left side of the transporting mechanism 10, at a bottom portion thereof. The platen 20 includes end axles 24, 26, and a roller portion 28. The axles 24, 26 provide for support of the platen 20 at opposite ends thereof. The platen 20 is rotatable about the axles 24, 26 by use of an external driving force, such as provided by a stepper motor driven gear and/or belt. A thermal print head 32 is disposed adjacent to the platen 20, and has linearly disposed print elements along a surface 34 that faces the roller surface 28. The print head 32 is pivotally attached to the forward and rearward frame members 12, 14, such that the surface 34 can be selectively pivoted to and pressed against the roller surface 28 along an axial extent of the roller surface. A print region is defined between the surface 34 of the thermal head 32 and the surface 28 of the platen 20.

A supply hub 42 and a take-up hub 44 extend perpendicularly from the rearward frame member 14 in the direction of the forward frame member 12. The supply and take-up hubs 42, 44 are directly driven by shafts 41, 43, respectively, and may have splines, locks, rings or other devices which secure a supply of ink ribbon to the respective hubs. Typically, an unused supply of ink ribbon in the form of a roll would be positioned on the supply hub 42, and the used ink ribbon would be collected on the take-up hub 44 after passing through the print region. An outside diameter of the respective hubs 42, 44 is selected to be commensurate with an inside diameter of a commercially available roll of ink ribbon.

A roller 46 is provided to guide the movement of the ink ribbon after it leaves the supply hub 42. The roller 46 has axles 48, 52 that support the roller at opposite ends thereof and provide for rotation of the roller about its axis. An outer surface of the roller 46 has a friction coefficient sufficient to prevent slippage of the ribbon as it travels across the roller. The axle 48 extends through the forward frame member 12, and is rotatably supported by the forward frame member. The axle 52 extends through the rearward frame member 14, and is rotatably supported by the rearward frame member. On the opposite side of the rearward frame member 14, the axle 52 is coupled to a gear 54. As will be further described below, rotation of the gear 54 drives the roller 46, which advances the ink ribbon to the print region.

A stepper motor 60 is disposed on the opposite side of the rearward frame member 14. Rather than rotating in a continuous manner, the stepper motor 60 rotates in finite radial increments. The step rate of the stepper motor 60 is controlled by a control signal provided to the stepper motor by a controller within the thermal printer, which will be described in further detail below. The stepper motor 60 has a rotatable shaft having a pinion 68 that engages a gear 62. The gear 62 is coupled to the supply hub 42 through a clutch 63. The gear 62 is also coupled to a pulley 65, which in turn drives a pulley 56 disposed on an idler shaft 57 through use of a synchronous belt 58. The pulley 56 rotates in cooperation with a gear 55 that, in turn, drives gear 54. Thus, both the supply hub 42 and the roller 46 are driven incrementally by the stepper motor 60.

A motor 70 is also disposed on the opposite side of the rearward frame member 14. Unlike the stepper motor 60, the motor 70 operates in a continuous manner. The motor 70 has a rotatable shaft having a pinion 72 that engages a gear 64, which in turn drives a gear 66 mechanically connected to the take-up hub 44. Thus, the take-up hub 44 is driven continuously by the motor 70.

Referring now to FIG. 3, a diagram illustrating the transport path of an ink ribbon 5 and a label sheet 7 is illustrated. The label sheet 7 is transported to the print region between the surface 28 of the platen 20 and the surface 34 of the thermal head 32. As known in the art, the label sheet 7 is transported in a step-wise manner, with each step having a magnitude equivalent to a height of the linearly disposed print elements on the surface 34 to permit printing of a single linear row of information. At the same time, the ink ribbon 5 is transported from the supply hub 42, across the roller 46 to the print region. After passing through the print region, the ink ribbon 5 is collected on the take-up hub 44.

The step-wise rotation of the pinion 68 of the stepper motor 60 causes similar step-wise rotation of the hub 42 opposite to the desired direction of travel of the ribbon 5. At the same time, the roller 46 is driven in the desired direction of the ribbon 5 by use of the belt 58 and pulley 56 turning the gear 55. The clutch 63 interposed between the gear 62 and the supply hub 42 permits slippage of the supply hub 42, while the friction coefficient surface on the roller 46 prevents slippage of the ribbon 5 across its surface. Meanwhile, the rotation of the take-up hub 44 applies a continuous tension on the ribbon 5, drawing the ribbon in the direction of the print region. Thus, the ribbon 5 is drawn in step-wise fashion from the supply hub 42, with a constant level of tension provided on the ribbon to prevent wrinkling of the ribbon. The magnitude of each step of the ribbon 5 corresponds with a step magnitude of the label sheet 7.

In accordance with the present invention, the step rate of the stepper motor 60 can be selectively controlled to be a fraction of the movement of the label sheet 7. Stepper motor 60 can be controlled to rotate at a significantly lower rate than that of the label sheet, such as 2:1, 3:1 or 4:1. For example, at a 2:1 ratio, the ink ribbon 5 would step once for every two incremental steps of the label sheet. Thus, the ink from the ink ribbon 5 would transfer twice onto the label sheet from the same location, maximizing the use of the multi-transfer ink ribbon. Further, in between adjacent print operations, the stepper motor 60 can be reduced to the lowest possible step rate, such as 20:1. This way, the ribbon 5 is advanced the smallest possible amount during periods in which no printing is occurring. It should be apparent that the advancement of the ribbon 5 cannot be stopped completely, otherwise the ribbon may be damaged by abrasion due to the advancement of the label sheet 7. Nevertheless, by advancing the ribbon 5 at the slowest possible rate relative to the advancement of the label sheet 7, the minimum amount of ribbon would be wasted during such periods of non-printing.

Alternatively, the ribbon 5 could be advanced by less than a full step with each associated step of the label sheet 7. For example, in a 4:1 ratio, the pinion 68 of the stepper motor 60 could advance one quarter of a step for every full step of the label sheet 7. This way, one quarter of the ribbon 5 disposed within the print region is fresh, and some of the ink from the remaining three quarters of the ribbon in the print region has been previously transferred. Thus, the benefit of a reduced rate for the ink ribbon 5 is achieved, without stopping the movement of the ribbon during successive steps of the label sheet 7.

Figure 5:
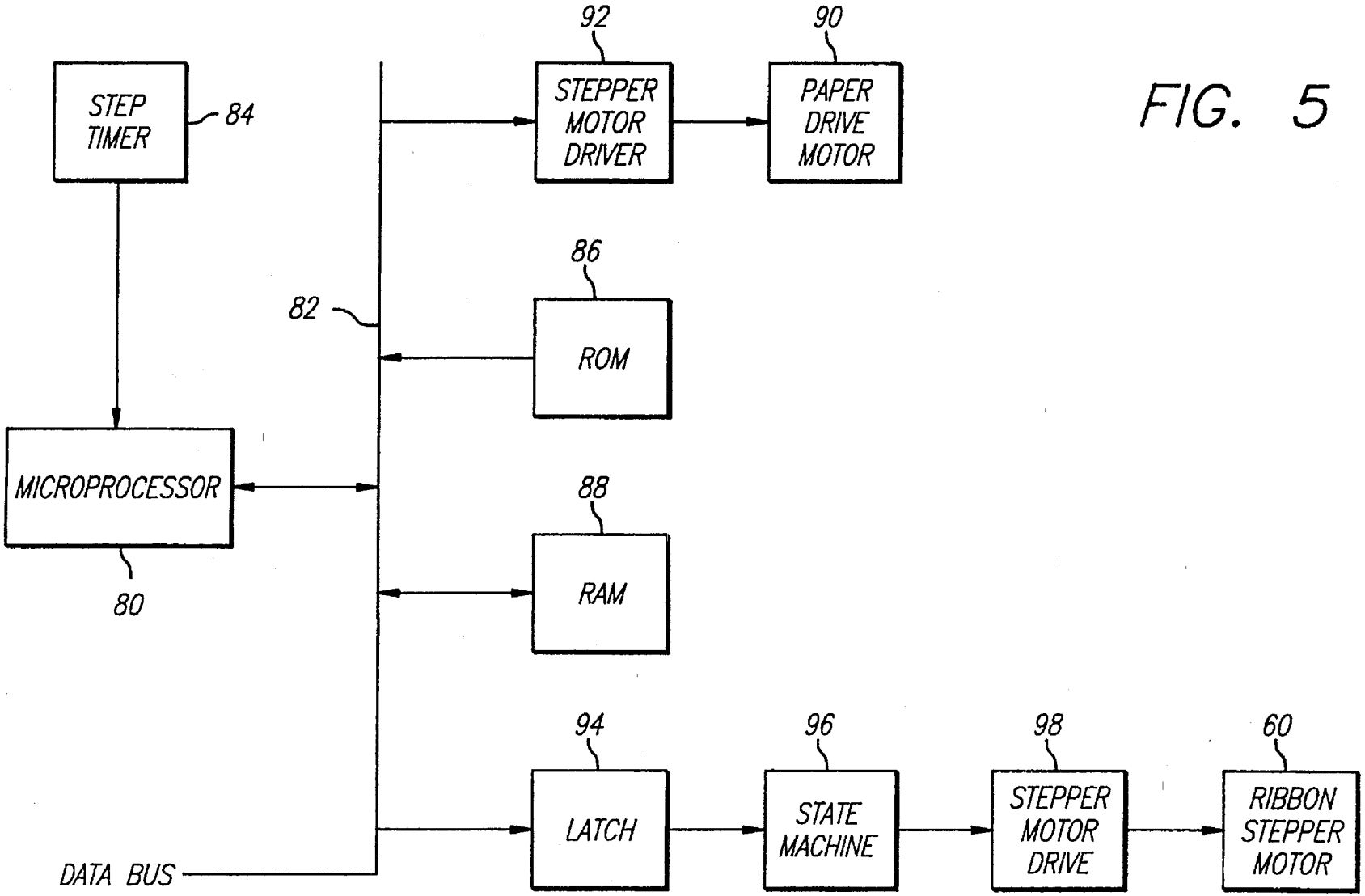
FIG. 5 is a block diagram illustrating control over a print rate for the transporting mechanism.

Referring now to FIG. 5, a block diagram illustrating control of the transporting mechanism is illustrated. The transporting mechanism is controlled by a central microprocessor 80 that is coupled through a data bus 82 to a read-only-memory (ROM) 86, and a random-access-memory (RAM) 88. As known in the art, the ROM 86 provides permanent storage of instructions or data for use by the microprocessor 80. The RAM 88 provides temporary storage of data for use by the microprocessor 80. Also coupled to the data bus 82 are a stepper motor driver 92 and a latch 94. The stepper motor driver 92 provides step pulses to a paper drive motor 90 to advance the label sheet 7 by a step. The latch 94 maintains a count of step pulses, and is coupled to a programmable state machine 96. In turn, the state machine 96 controls a stepper motor driver 98 that provides step pulses to ribbon stepper motor 60 to advance the ribbon 5 by a step.

The microprocessor 80 receives an input from the step timer 84 that indicates whether a step of either the paper drive motor 90 or the ribbon stepper motor 60 should take place. The step signal interrupts the microprocessor 80, which causes the microprocessor to update the stepper motor driver 92 with the next data in the stepping sequence. Upon receipt of the step interrupt signal, the microprocessor 80 also sends a signal to the state machine 96 indicating that a step has occurred. The state machine 96 counts each of these signals and issues data for the next step sequence when the count reaches the proper ratio value which has been programmed into the state machine by the microprocessor 80.

For example, to achieve a 4:1 paper-to-ribbon ratio, the microprocessor 80 first programs the ratio into the state machine 96 via the data bus 82. When each step interrupt signal is issued by the step timer 84, the microprocessor 80 updates the paper drive motor driver 98 with data causing the motor 90 to take a step, and also issues a step signal to the state machine. The state machine 96 counts the step signals and updates the ribbon stepper motor 60 once for every four step signals issued by the microprocessor 80. The ribbon stepper motor 60 thus moves the ribbon 5 one fourth the distance that the paper motor 90 moves the label sheet 7.

Having thus described a preferred embodiment of a method and apparatus for controlling transport of thermal transfer ribbon, it should be apparent to those skilled in the art that certain advantages of the within system have been achieved. It should also be appreciated that various modifications, adaptations, and alternative embodiments thereof may be made within the scope and spirit of the present invention. The invention is further defined by the following claims.

What is claimed is:

1. An apparatus for use in a thermal printer for printing information onto a paper substrate material, comprising:

a platen;

a thermal head disposed adjacent the platen having a region defined therebetween through which said paper substrate material is transported at a first step rate;

means for transporting an ink ribbon to said region so that ink from said ink ribbon can be transferred onto said paper substrate by operation of said thermal head to print said information, said means transporting said ribbon to said region at a second step rate that is substantially less than said first step rate, wherein said transporting means further comprises:

a supply hub carrying a supply of said ribbon;

a first motor mechanically linked to said supply hub, the first motor rotating said hub in a direction opposite to advancement of the ribbon at said second step rate;

a roller mechanically linked to said first motor and having a surface engaging said ribbon, said roller surface having a friction coefficient sufficient to prevent slippage of said ribbon;

a second motor applying a tension on said ribbon; and a clutch interposed between said first motor and said supply hub, said clutch permitting slippage of said supply hub to permit advancement of said ribbon at said second step rate.

2. An apparatus for use in a thermal printer for printing information onto a paper substrate material, comprising:

a platen and means for rotating the platen;

a thermal head disposed adjacent the platen such that said paper substrate material is drawn to a region between said platen and said thermal head by rotation of said platen, said thermal head being capable of printing said information onto said paper substrate material, said paper substrate material being transported to the region between said platen and said thermal head at a first rate; and means for transporting a ribbon having a multi-transfer ink donor layer disposed on a single side thereof to said region between said platen and said thermal head so that ink from said ink donor layer can be imprinted onto said paper substrate by operation of said thermal head to produce said information, said means transporting said ribbon to said region at a second rate that is substantially less than said first rate, wherein said transporting means further comprises:

a supply hub carrying a supply of said ribbon;

a first motor mechanically linked to said supply hub, the first motor rotating said hub in a direction opposite to advancement the ribbon at said second rate;

a roller mechanically linked to said first motor and having a surface engaging said ribbon advanced from said supply hub to said region between said platen and said thermal head, said roller surface having a friction coefficient sufficient to prevent slippage of said ribbon due to said rotation of said platen;

a second motor applying a constant advancing tension on said ribbon; and a clutch interposed between said first motor and said supply hub, said clutch permitting slippage of said supply hub to permit advancement of said ribbon at said second rate.

3. The apparatus of claim 2, wherein said first motor is a stepper motor.

4. The apparatus of claim 2, further comprising a take-up hub mechanically linked to said second motor, said take-up hub receiving said ribbon after its passage through said region between said platen and said thermal head.

5. An apparatus for printing images onto a paper label sheet material utilizing a ribbon having a multi-transfer ink layer, comprising:

a platen and a thermal head disposed adjacent the platen having a region defined therebetween through which said label sheet is transported at a first rate, said images being imprinted onto said label sheet by operation of said thermal head in cooperation with ink from said ribbon advanced to said region;

a supply hub carrying a supply of said ribbon;

a first motor mechanically linked to said supply hub, the first motor rotating said hub in a direction opposite to a direction of advancement of the ribbon;

a roller mechanically linked to said first motor and having a surface engaging said ribbon, said roller surface having a friction coefficient sufficient to prevent slippage of said ribbon;

a second motor applying a tension on said ribbon; and a clutch interposed between said first motor and said supply hub, said clutch permitting slippage of said supply hub to permit advancement of said ribbon;

wherein said ribbon is transported to said region at a second rate that is selectively lower than said first rate.

6. The apparatus of claim 5, wherein said first motor rotates said supply hub and said roller at said second rate.

7. The apparatus of claim 5, wherein a ratio between said first rate and said second rate is at least 4:1.

8. The apparatus of claim 5, further comprising means for selectively reducing said second rate between printing operations.

9. The apparatus of claim 5, further comprising means for controlling operation of said first motor.

* * * * *